United States Patent [19]

Frame

[11] 4,369,393

[45] Jan. 18, 1983

[54] ELECTROLUMINESCENT DISPLAY INCLUDING SEMICONDUCTOR CONVERTIBLE TO INSULATOR

[75] Inventor: Norman J. Frame, Whitefish Bay, Wis.

[73] Assignee: W. H. Brady Co., Milwaukee, Wis.

[21] Appl. No.: 211,085

[22] Filed: Nov. 28, 1980

[51] Int. Cl.[3] ..... H05B 33/02; H05B 33/14; H05B 33/22

[52] U.S. Cl. ..... 313/506; 313/509

[58] Field of Search ..... 313/506

[56] References Cited

U.S. PATENT DOCUMENTS 4,099,091 7/1978 Yamazoe et al. ..... 313/509

4,188,565 2/1980 Mizukami et al. ..... 313/509

*Primary Examiner*—Robert Segal

[57] ABSTRACT

An electroluminescent display which includes a thin film layer of a material which, if undue current passes through a portion of it, that portion is converted from a semiconductor into an insulator.

3 Claims, 2 Drawing Figures

ELECTROLUMINESCENT DISPLAY INCLUDING SEMICONDUCTOR CONVERTIBLE TO INSULATOR

FIELD OF THE INVENTION

This invention relates to electroluminescent displays.

BACKGROUND OF THE INVENTION

It is known in the prior art to provide an electroluminescent structure in which there is provided beneath a luminescent layer a black layer for contrast enhancement; e.g., "High Display Viewability Provided by Thin-Film EL, Black Layer, and TFT Drive," K. O. Fugate, IEEE Transactions on Electron Devices, Vol. ED-24, No. 7, July 1977, p. 909. It is known in the capacitor art that the effect of defects such as pinholes in a tantalum pentoxide layer may be overcome by an adjacent layer of manganese dioxide upon placing a voltage across the two layers in series; e.g., "Sputtered Manganese Dioxide as Counterelectrodes in Thin Film Capacitors", Landorf et al., Bell Telephone Laboratories, J. Electrochem. Soc. Vol. 119, No. 4, April 1972, p. 430.

SUMMARY OF THE INVENTION

I have discovered that an improved thin film electroluminescent display structure can be provided if there is included in it a layer of convertible semiconductor. By "convertible", I mean that at current densities caused in the device if there is a defect in an insulating layer resulting in undesired current flow, the material is converted at the place of such flow from a semiconductor to an insulator, thus stopping the flow. In a preferred embodiment, the insulating layer comprises tantalum pentoxide and the semiconductor is manganese dioxide.

In another aspect of the invention, I have discovered that the electroluminescent portions of the device may be defined by first laying down a layer of electroluminescent host material and thereafter doping this layer in selected portions with an electroluminescent activator. In a preferred embodiment, the host material is zinc sulfide and the activator is manganese.

PREFERRED EMBODIMENT

Drawings

There is shown:

Description

Turning now to the drawings, there is shown an electroluminescent display indicated generally at 10.

Soda lime glass support 12, ⅛" in thickness, supports transparent conductor layer 14 of electrically conductive SnO2 3,000 Ångstrom units in thickness (deposited by RF sputtering tin in the presence of oxygen). Supported thereon is insulating layer 16 of tantalum pentoxide, 4,000 Ångstrom units in thickness (deposited by RF sputtering of tantalum in the presence of oxygen).

Figure 1:
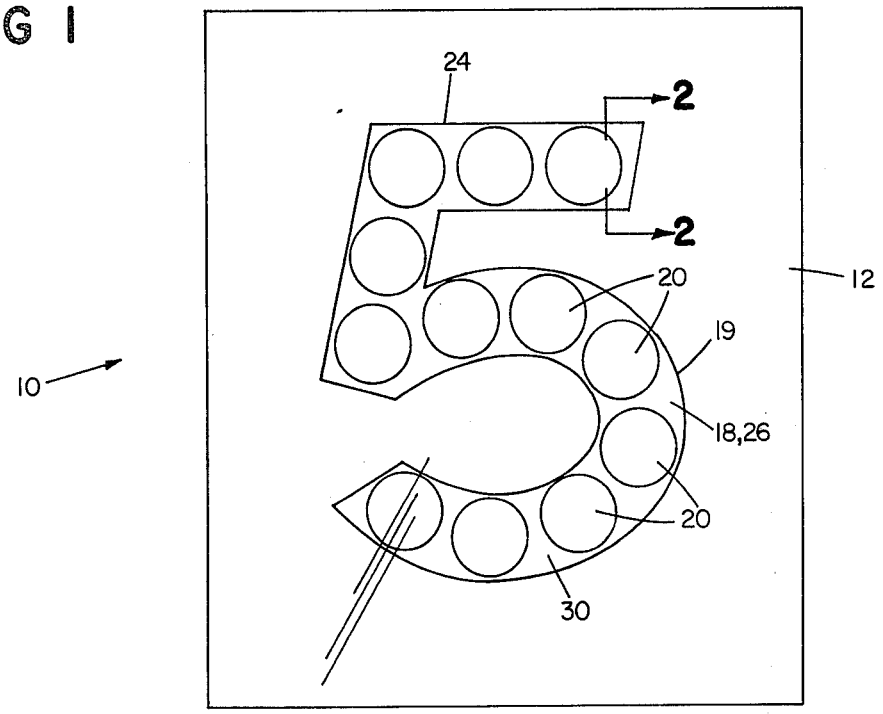
FIG. 1 is a plan view of a preferred embodiment of the invention.
Figure 2:
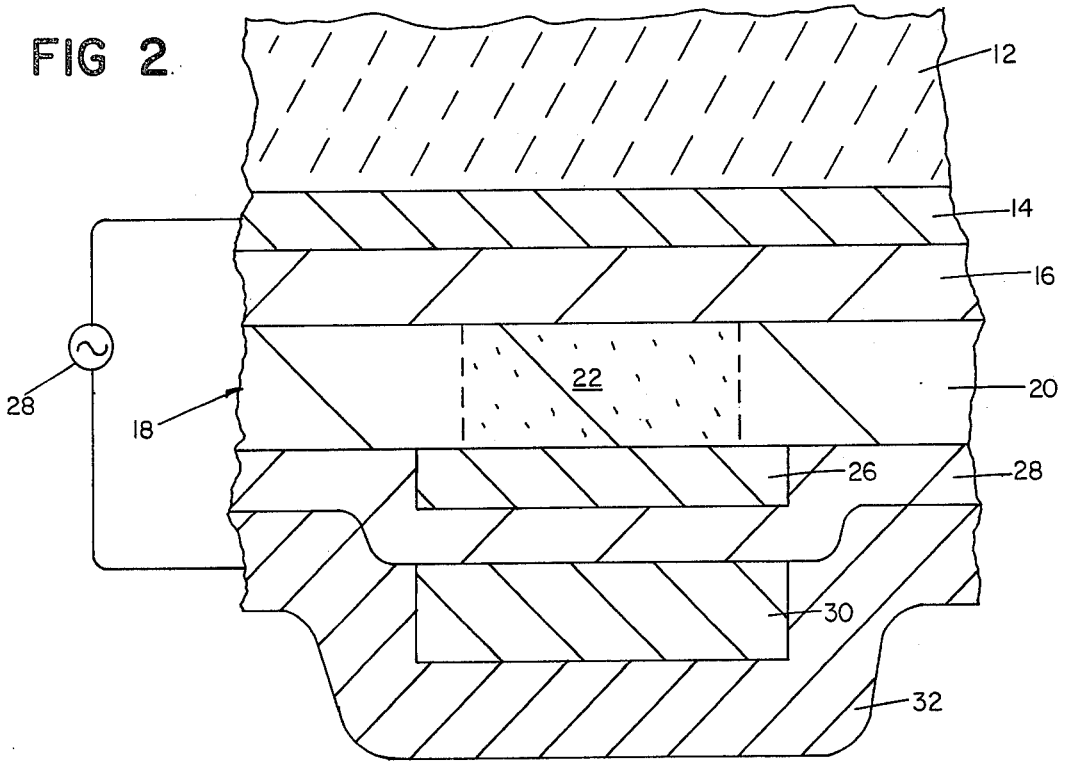
FIG. 2 is an enlarged cross-sectional view taken at 2—2 of FIG. 1.

On layer 16 is more complex layer 18, which includes electroluminescent portion 22 and non-electroluminescent portion 20. Layer 18 is formed by first evaporating zinc sulfide to a thickness of 6,500 Ångstrom units. Following this, manganese is deposited through a mask to a thickness of 75 Ångstrom units over the round areas 22, as shown in FIG. 1. Thereafter a vacuum is drawn, helium is backfilled to a pressure of 1,000 microns, and temperature is raised to 550° C. for one hour, to diffuse the manganese into zinc sulfide. (Although in the drawing the entire portion 22 is shown within the dotted lines as uniform, it is not known the precise depth to which the diffusion takes place, nor the precise configuration of the zone boundaries.) In this embodiment the zinc sulfide is the host and the manganese is the activator.

On layer 18 is deposited, over the area indicated at 24 in FIG. 1 a convertible semiconductor layer 26 of manganese dioxide 3000 Ångstrom units in thickness (deposited by RF sputtering of manganese, in the presence of oxygen, through a mask). Supported by layers 18 and 26 over the entire area of the device is insulating layer 28 of tantalum pentoxide 4000 Ångstrom units in thickness (deposited by RF sputtering tantalum in the presence of oxygen).

Next is electrode layer 30 of aluminum, deposited over the area 24, but with tail (not shown) extending therefrom to the exterior for electrical connection through alternator 28 with layer 14.

The device is finished off with a black silastic potting layer 32, for protection and added contrast enhancement.

Operation

In my invention the manganese dioxide layer 26 counteracts the effect of defects such as pinholes in tantalum pentoxide layer 28, as well, I believe, as defects in the layers 16 and 18. The $MnO_2$ layer 26 additionally advantageously provides the advantage of contrast enhancement.

The invention technique of defining of electroluminescent zones permits the achievement of complex and interesting display patterns, all activatable by the single electrode 30, so that the zones 22 become luminescent when the electrical source 28 is activated.

Other Embodiments

Other techniques for forming layers may of course be used. Other materials may be used. For example SiO may be used as an insulating layer. Although yet untested, it is believed that reversal of deposits of the layer 26 and 28, to eliminate the step in the latter, may be the most preferred embodiment.

What is claimed is:

1. An electroluminescent display comprising an upper, transparent electrode layer, a first insulating layer beneath said electrode layer, a layer of electroluminescent material below said first insulating layer, a layer of manganese dioxide beneath said electroluminescent layer, said manganese dioxide acting as a convertible semiconductor so as to convert to an insulator at places of high current flow in order to stop such flow, said manganese dioxide also providing contrast enhancement to said display, and said manganese dioxide layer extending only part way beneath said electroluminescent layer so as to be beneath desired areas of display, a second insulating layer beneath said electroluminescent layer, and a lower electrode layer beneath said insulator layer.

2. The display of claim 1 in which said insulating layers are tantalum pentoxide.

3. The display of claim 1 further comprising a protective, contrast-enhancing coating beneath said lower electrode.

* * * * *